US005221879A

United States Patent [19]

Taniguchi et al.

[11] Patent Number: 5,221,879

[45] Date of Patent: Jun. 22, 1993

[54] METHOD AND APPARATUS FOR WINDING A CORD CONTINUOUSLY IN DIP TREATING APPARATUS

[75] Inventors: Toshiharu Taniguchi; Takaaki Ueda, both of Kobe, Japan

[73] Assignee: Bando Chemical Industries, Ltd., Kobe, Japan

[21] Appl. No.: 753,881

[22] Filed: Sep. 3, 1991

[30] Foreign Application Priority Data

Sep. 21, 1990 [JP] Japan ..... 2-252917
Sep. 28, 1990 [JP] Japan ..... 2-261103
Sep. 28, 1990 [JP] Japan ..... 2-261104
Sep. 28, 1990 [JP] Japan ..... 2-261105

[51] Int. Cl.[5] ..... B65H 59/38; D02J 13/00
[52] U.S. Cl. ..... 318/7; 318/34
[58] Field of Search ..... 318/6, 7, 34; 242/45, 242/75, 75.3, 75.42, 75.43, 75.44

[56] References Cited

U.S. PATENT DOCUMENTS 3,887,851 6/1975 Loesch ..... 318/6
4,350,936 9/1982 Jackson ..... 318/7
4,436,251 3/1984 Deyesso et al. ..... 318/7 X
4,812,721 3/1989 Graham et al. ..... 318/66
4,997,120 3/1991 Tanaka et al. ..... 226/44
5,000,394 3/1991 Wales et al. ..... 242/58.6

*Primary Examiner*—Bentsu Ro
*Attorney, Agent, or Firm*—Sixbey, Friedman, Leedom & Ferguson

[57] ABSTRACT

The invention discloses a method and an apparatus for winding a cord continuously. A rotation of a winding bobbin around which a cord to be a tension member of a belt, is wound and detected directly or indirectly. A cord is forwarded in an axial direction of a winding bobbin at a pitch, which corresponds to a diameter of the cord, in relation to a rotation of a winding bobbin. The bobbin axis of the winding bobbin is rotated at a constant speed by rotation driving means so that the cord is wound around the winding bobbin. The rotation of the bobbin axis is detected by rotation detection means directly or indirectly. The cord is forwarded in the axial direction of the winding bobbin in relation to the rotation of the winding bobbin at a pitch which corresponds to the diameter of the cord by receiving signals from the rotation detection means.

1 Claim, 13 Drawing Sheets

METHOD AND APPARATUS FOR WINDING A CORD CONTINUOUSLY IN DIP TREATING APPARATUS

BACKGROUND OF THE INVENTION

This invention relates to a method and an apparatus for winding a cord continuously in dip treating apparatus.

In order to improve adhesiveness of a cord to be used as a tension member of a belt a dip treating apparatus for sticking adhesives to the surface of the cord has been known.

The diameter of a cord, to be used as a tension member of a power transmission belt varies according to the type of a belt. In order to obtain a neat roll, an automatic cord winder needs to wind a cord around a winding bobbin correspondingly to the diameter of the cord.

Therefore, a winding pitch to wind a cord to a winding bobbin is adjusted by changing a cord forward speed of forwarding means (for example, a traverse pulley) for forwarding a cord in an axial direction of the bobbin, or by changing a pulley ratio by taking out a torque from the driving system for rotation of the bobbin.

In the former example, the cord forward speed should be changed correspondingly not only to the diameter of the cord but also to a winding speed of the cord to the automatic winder. Thus, control of cord forward speed becomes complicated. In the latter example, since the pulley ratio is changed, pulleys should be changed by stopping the operation of the automatic winder every time the cord is changed. Thus, extra work is required to change pulleys and the overall mechanism becomes complicated.

In the dip treating apparatus, in order to obtain higher winding efficiency, dip treatment may be processed continuously from two cheeses around which untreated cord is wound.

However, in the above case, it is required to wind the cord that has finished dip treatment around one bobbin for one cheese around which the untreated cord is wound. To satisfy that request, a cord is wound continuously around a first and a second bobbin provided coaxially in a row at a specified interval. However, the bobbin which winds the cord first should be selected by, for example, a select switch. If the first bobbin is selected by the select switch at start-up, a control part switches the winding from the first bobbin to the second bobbin when the first bobbin is full.

However, for example, if the first bobbin starts winding the cord and the operation for that day is finished in the middle of the second bobbin, when the power source is turned off the control part is cleared and there is no indication that the second bobbin was winding the cord. In this situation, if an operator forgets to position the select switch to the second bobbin the following day, a winding mistake may occur since the select switch stays in the same position as the day before, which means that the first switch is selected.

SUMMARY OF THE INVENTION

The object of the present invention is to provide a method and an apparatus for winding a cord automatically into a neat roll, irrespective of the diameter of the cord.

In order to achieve the above object, the apparatus of the present invention is constructed as follows: rotation of a winding bobbin, around which a cord is wound, is detected directly or indirectly, and the cord is forwarded in an axial direction of the winding bobbin with a pitch which corresponds to the diameter of the cord in relation to the rotation of the winding bobbin. Thus, the rotation of the winding bobbin around which the cord is wound is detected directly or indirectly, and the cord is forwarded in the axial direction of the winding bobbin at a pitch which corresponds to the diameter of the cord in relation to the rotation of the winding bobbin. Since the cord is forwarded in the axial direction of the winding bobbin correspondingly to the rotating speed of the winding bobbin, the roll of the winding bobbin becomes neat.

The apparatus for winding a cord continuously comprising a winding bobbin around which the cord is wound, rotation driving means for rotating a bobbin axis of the bobbin at a constant speed, rotation detection means for detecting a rotation of the bobbin axis directly or indirectly, and forwarding means for forwarding the cord in the axial direction of the winding bobbin at a pitch which corresponds to a diameter of the cord by receiving signals from the rotation detection means in relation to the rotation of the bobbin. Thus, rotation of the winding bobbin around which the cord is wound is detected directly or indirectly. Relating to the rotation of the winding bobbin, the cord is forwarded in the axial direction of the winding bobbin at a pitch which corresponds to the diameter of the cord. Since the cord is forwarded in the axial direction of the winding bobbin by the forwarding means at a pitch which corresponds to the diameter of the cord according to the rotating speed of the winding bobbin which is detected by the rotation detection means, the cord is wound neatly around the winding bobbin using a winding apparatus having simple structure.

A further object of the present invention is to switch bobbins automatically and to provide a continuous cord winding apparatus which prevents winding mistakes. In the cord supply side, the cord is wound around the first and the second cheeses. In the cord wind side, the first and the second bobbins are provided coaxially in a row at a specified interval, the cord from the first cheese is wound around the first bobbin and the cord from the second cheese is wound around the second bobbin. This continuous cord winding apparatus comprises joint part detection means for detecting a joint part where the tail end of the cord of the first cheese and the front end of the cord of the second cheese join each other, cord moving means for moving the cord from the cord supply side along the axial direction of the first and the second bobbins, and winding changing means for changing from the first bobbin which winds the cord to the another bobbin automatically. Thus, if the joint part is detected by the joint part detection means, the winding changing means controls the cord moving means, and the bobbin is changed automatically from the first bobbin which is winding the cord to the other bobbin after winding to that first bobbin is completed. Thus, the bobbin to wind the cord is switched automatically without error and the cord is wound continuously to one bobbin after the other. Also, since the joint part is positioned at the end of the bobbin, the joint part is easily processed (destruction). That means extra work is not required since the joint part does not exist in the bobbin if the joint part does not exist in the cheese.

Moreover, in the present invention, the limit switch for indicating the bobbin in use is interposed between the first and the second bobbins. In this case, when the bobbin is changed from the one which is winding the cord to the other bobbin, the limit switch operates to indicate which bobbin is winding the cord. Thus, winding mistakes are prevented at the start of winding the cord.

A further object of the present invention is to prevent the speed of forwarding the cord from becoming high, which is caused by slip of the cord, and to provide the continuous cord winding apparatus which can process stable dip treatment and winding of the cord continuously.

The dip treating apparatus of the present invention includes a plurality of driving motors for controlling the forward speed of the cord. The apparatus is provided with control means for maintaining a constant rotating speed of the driving motor which is at second motor position from the untreated cord supply side and for controlling the rotating speed of other driving motors relative to the cord forward speed by receiving signals from the dancer apparatus for detecting the forward speed of the cord. Thus, when the cord slips in the cord supply side before the dip treatment, the dancer apparatus detects it and decelerates the first driving motor from the cord driving side. By this, the forward speed of the cord is restricted and does not affect the other driving motors. Thus, the rotating speed of the second motor which is at a second position from the cord supply side is maintained constant. Also control means for variably controlling the rotating speed of other driving motors relative to the cord forward speed by receiving signals from the dancer apparatus for detecting the cord forward speed is provided. Therefore, the cord forward speed and the dip treatment process is stabilized while the cord is wound into a neat roll.

A further object of the invention is to prevent the loss of the cord during the heating process in the heat and dry oven means.

A cord dip treating apparatus of the present invention directs a cord to be used for a tension member of a belt through a dip tank means to be coated with adhesives. Then the cord goes through the heat and dry oven to dry the adhesives which stick to the surface of the cord. When temperature inside of the heat and dry oven means is raised, the cord inside of the heat and dry oven means is changed to a cord which is not deformed by heat (for example, aromatic polyamide cord). Therefore, loss of cord caused by elevated temperatures in the heat and dry oven means is prevented.

BRIEF DESCRIPTION OF THE DRAWINGS

The accompanying drawings show preferred embodiments of the present invention, in which.

DETAILED DESCRIPTION OF THE INVENTION

Embodiments of the present invention will be described below with reference to the accompanying drawings.

Figure 1:
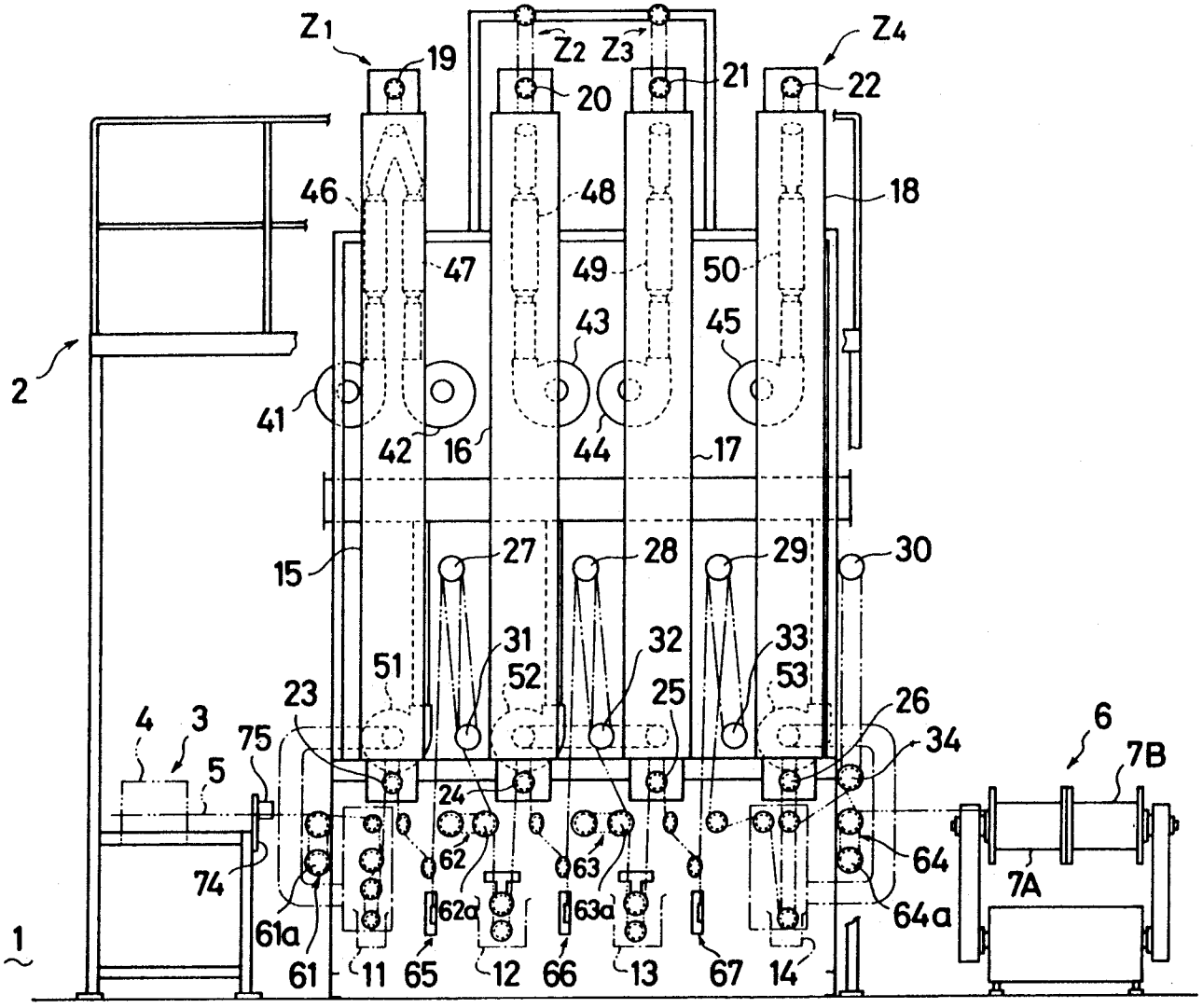
FIGS. 1 and 2 show a front rough sketch and enlarged side rough sketch of a vertical type dip treating apparatus respectively.
Figure 2:
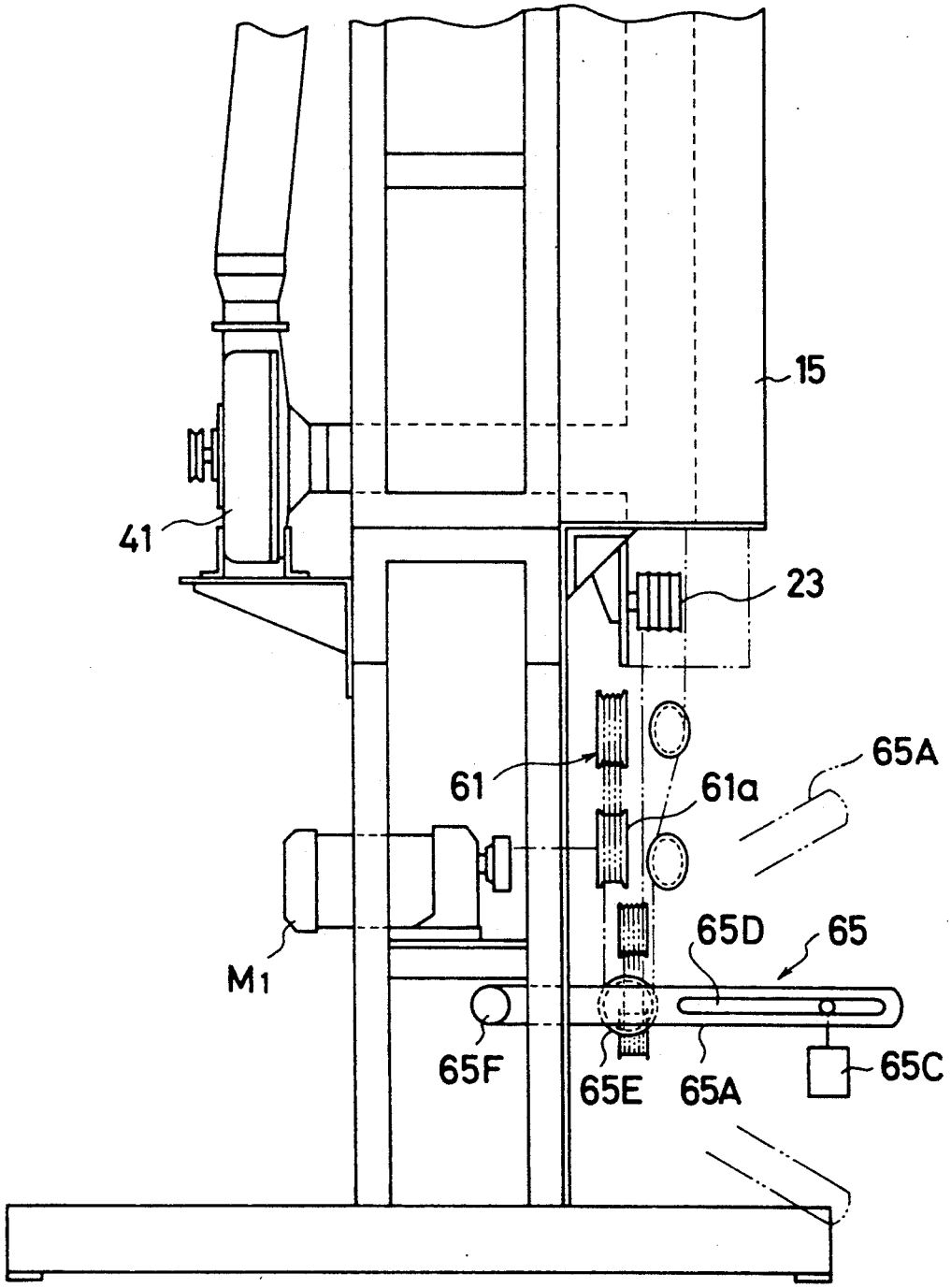
Figure 5:
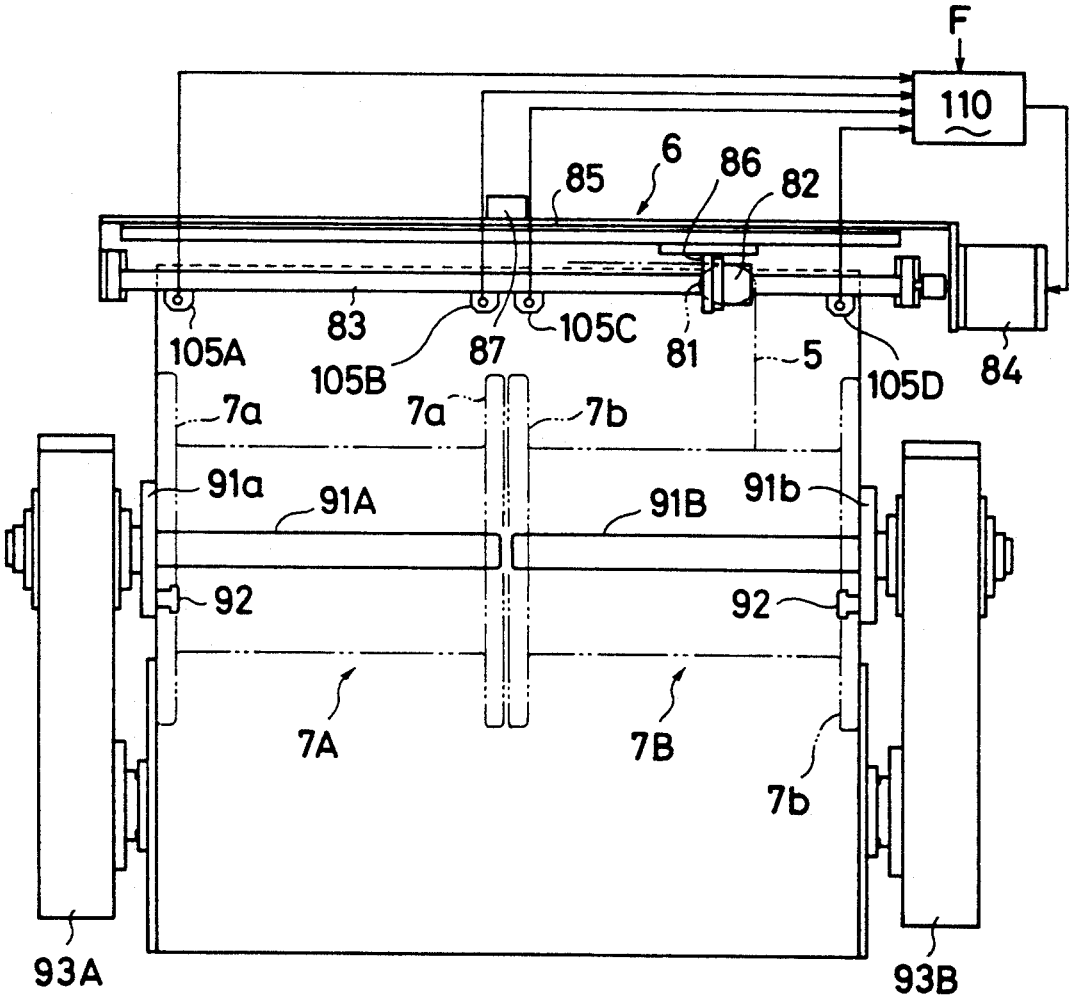
FIGS. 5 and 6 show a plan view and a fragmentary sectional side view of an automatic winder respectively.
Figure 6:
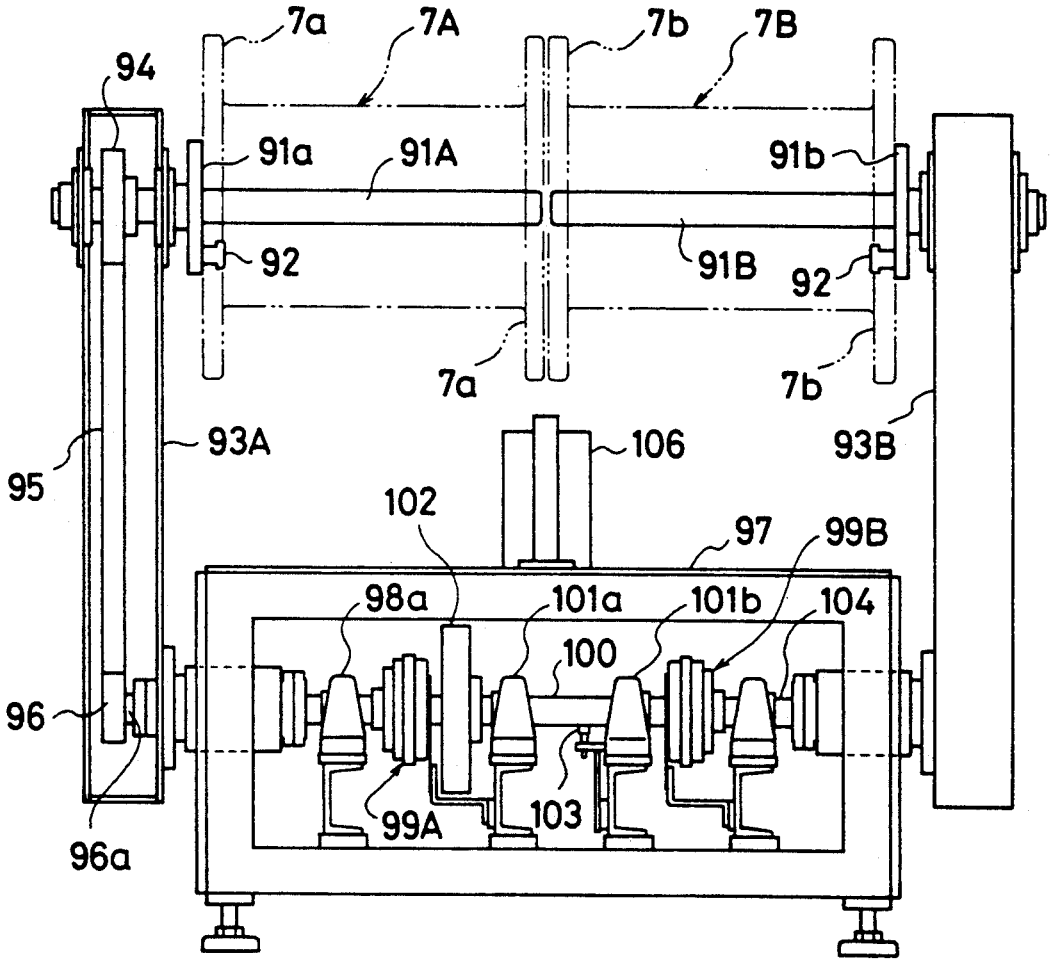

FIGS. 1 and 2 show the overall composition of a vertical type dip treating apparatus. A dip treating apparatus 1 has a creel stand 3, which is shown in detail in FIGS. 3 and 4, at the lower part of an inspecting stand 2. An untreated cord 5 which is drawn out of a first cheese 4A and a second cheese 4B supported rotatably by the creel stand 3 is treated at a first zone Z1 through a fourth zone Z4 with three kinds of adhesives (dip treating liquid). A dip treated cord 5 is wound continuously around a first bobbin 7A and a second bobbin 7B which are arranged coaxially in a row at an automatic winder 6 as shown in FIGS. 5 and 6.

At zones Z1–Z4, a first through a fourth dip tank means 11–14 are arranged at the lower part respectively. Arranged at the upper part of dip tank means 11–14 are a first through a fourth ovens 15–18 respectively. Each oven, which is used for heating and drying the cord 5 treated in the dip tanks 11–14 is vertically long and corresponds to each dip tank 11–14.

Adhesives contained in the dip tanks 11–14 are, for example, isocyanide+toluene in the first dip tank 11, RFL (resorcin formalin latex)/water in the second and the third dip tanks 12 and 13, and glue rubber+tuluene in the fourth dip tank 14.

In the first oven 15 through the fourth oven 18, the cord 5 is wound around between, above and below fluted turn rollers, namely between 19 and 23, 20 and 24, 21 and 25, and 22 and 26, by plural turns so that the cord is dried and heated.

In order to cool the cord 5 heated in the ovens 15–18, pairs of rollers 27 and 31, 28 and 32, 29 and 33, and 30 and 34 are provided, one of each pair is positioned at an upper side and the other is positioned at lower side, in the direction of forwarding the cord, i.e., laid adjacently on side of the first through the fourth ovens 15–18 respectively. The cord 5 is wound around and between pairs of rollers 27 and 31, 28 and 32, 29 and 33, and 30 and 34 by plural turns so as to cool the cord below a predetermined temperature.

A first through a fifth direct drive type blower 41–45 for providing hot air into ovens 15–18 and a first though a fifth heater 46–50 are arranged adjacently on an upper part of the first through the fourth ovens 15–18 respectively. Also, a first through a third blower 51–53 for exhausting exhaust air from the first through the fourth ovens 15–18 are arranged on a lower part of the first through the fourth ovens 15–18 respectively.

A first through a fourth pull rollers 61–64, which wind the cord by plural turns between two pull pulleys so as to provide tension to the cord 5, are provided in front of each of the first through the third dip tank 11, 12, 13 and in the rear of the fourth zone Z4. Each driving motor M1–M4 controls each one of the pull rollers 61a–64a of the first through the fourth pull rollers 61–64.

Figure 7:
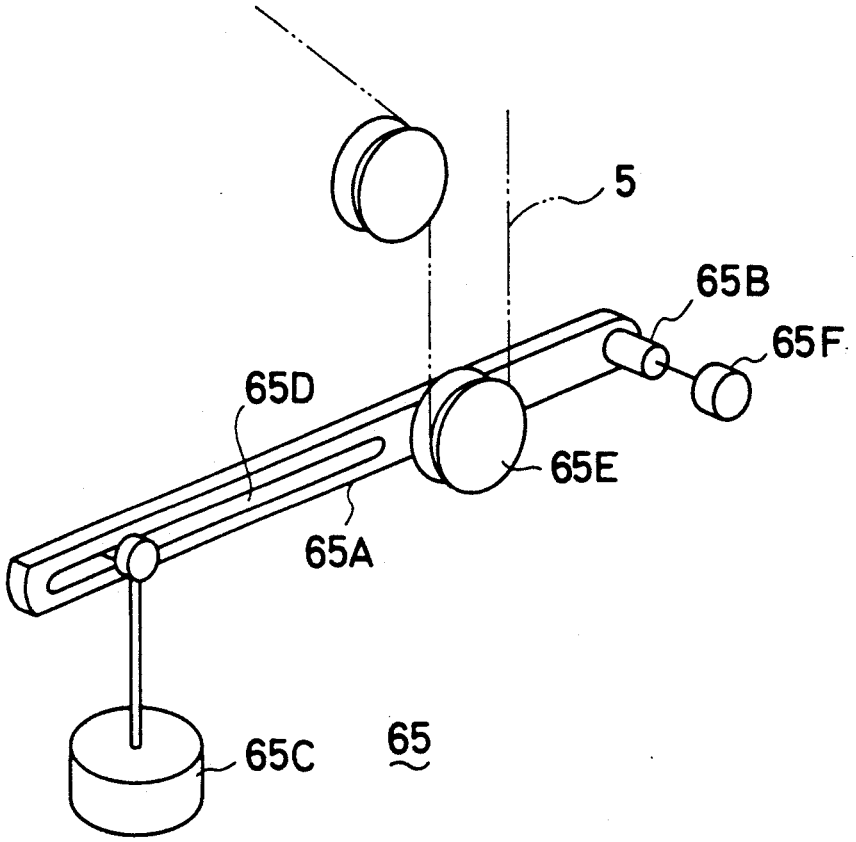
FIG. 7 show a perspective view of a first dancer apparatus.

Furthermore, a first through a third dancer apparatuses 65–67 for detecting forward speed of the cord 5 are interposed between a first zone Z1 and a second zone Z2, the second zone Z2 and a third zone Z3, and the third zone Z3 and a fourth zone Z4 respectively. For example, the first dancer apparatus 65 is as shown in FIG. 7. A tension bar 65A is supported rotatably in a vertical direction through a support shaft 65B at a base end part. The cord 5 is wound around a roller 65E supported rotatably in the base end part side of a top end long hole part 65D. A dead weight 65C of the tension bar 65A movably engages long hole part 65D. A detector 65F is connected to the base end part and the tension bar 65A moves up and down according to the cord 5. The detector 65F detects that vertical movement and maintains the tension bar 65A horizontally by changing speed of a driving motor M1. When the tension bar is horizontal, it is a stable situation.

Figure 3:
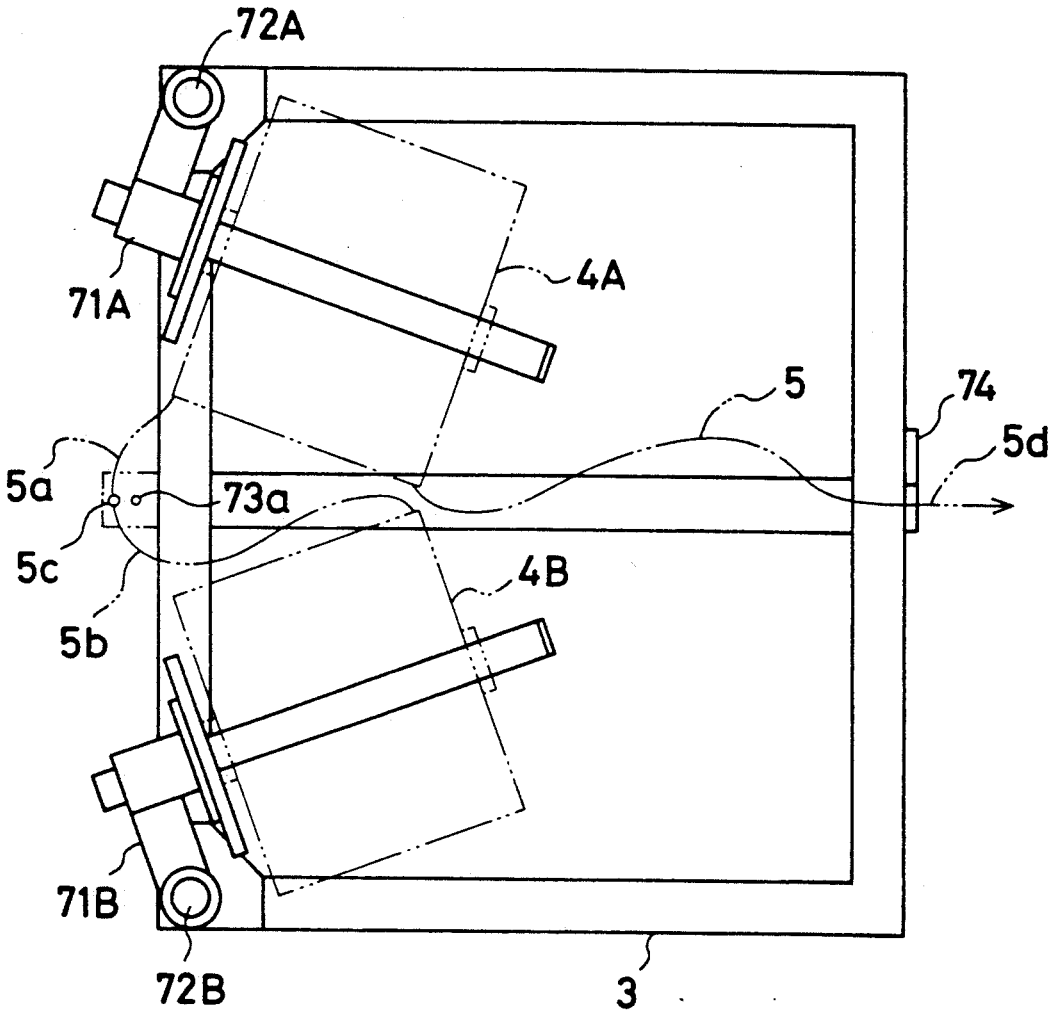
FIGS. 3 and 4 show a plan view and side view of a creel stand respectively.
Figure 4:
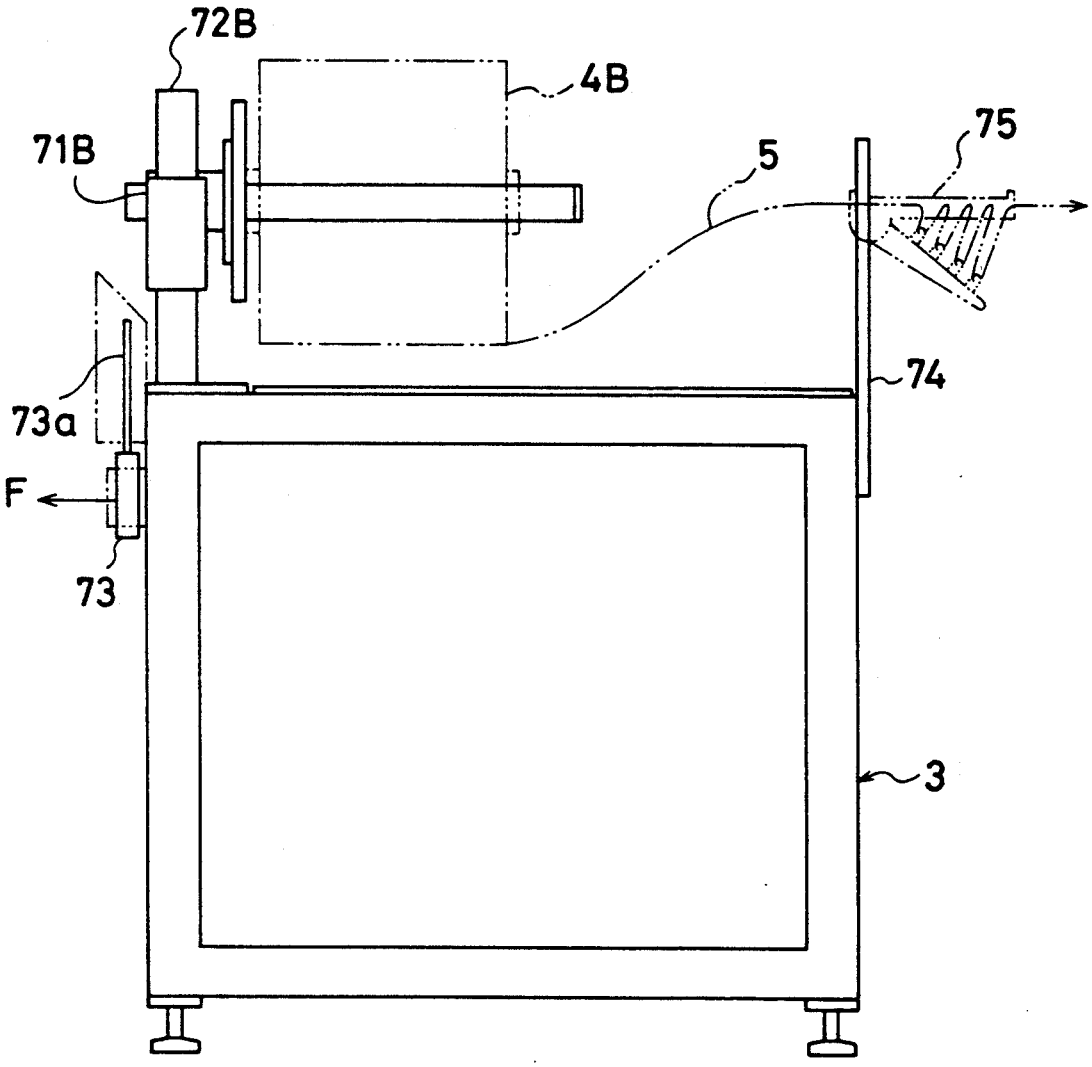

As shown in FIGS. 3 and 4, the creel stand 3 is supported by vertical axes 72A, 72B through mounting parts 71A, 71B so that the angle between the axes of the first and the second cheeses 4A, 4B is 40°. A tail end of the cord 5 of the first cheese 4A and a front end of the cord 5 of the second cheese 4B are connected to each other and form a joint part 5c. A contact maker 73a of a limit switch 73 for detecting the joint part is connected to the joint part 5c so as to detect whether the joint part 5c passes contact maker 73a and to output a joint part detecting signal F.

A front end 5d of the cord 5 of the first cheese 4A is forwarded to the dip treating apparatus 1 after a predetermined tension is applied to it by a tensioner 75 provided on an upper part of the guide member 74.

As shown in FIGS. 5 and 6, an automatic winder L includes a traverse pulley 81 around which the dip treated cord 5 is wound before it is wound around the bobbins 7A, 7B. Transversely pulley is supported rotatably by a movable stand 82 and is screwed movably on a screw rod 83 extending along the axial line of the bobbins 7A, 7B. The screw rod 83 is driven for rotation by the stepping motor 84. By rotation of the screw rod 83, a movable stand 82 and the traverse pulley 81 traverse between the first bobbin 7A and the second bobbin 7B so that winding of the cord 5 can be changed from the first bobbin 7A to the second bobbin 7B or vice versa.

The movable stand 82 has an engaging convexed part 86 which engages slidably with a fixed rail member 85 projecting to the rear and extending in parallel with the screw rod 83, whereby the movable stand 82 is prevented from rotating with the rotation of the screw rod 83.

Figure 8:
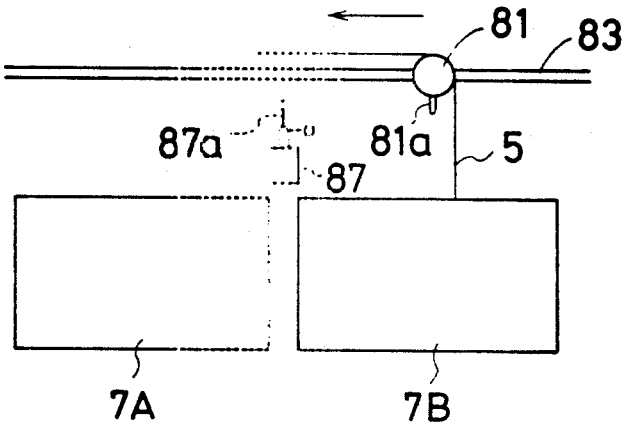
FIGS 8 and 9 are explanatory drawings of a limit switch.
Figure 9:
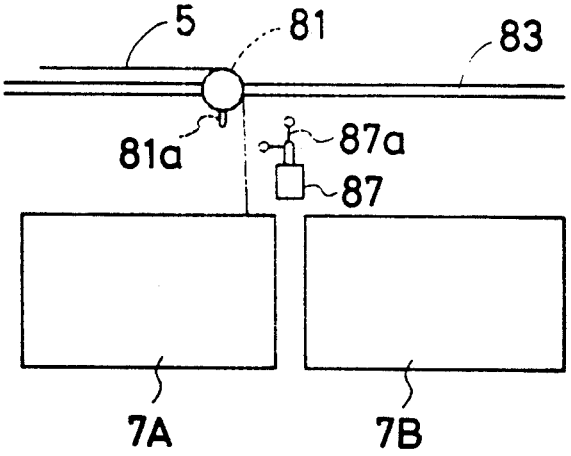

Arranged between the first and the second bobbins 7A and 7B is a limit switch 87, which changes contact maker 87a thereof when changing a bobbin from the first bobbin 7A to the second bobbin 7B or vice versa in order to indicate to an operator the bobbin winding the cord 5 at that moment. In detail, FIG. 8 shows the situation when the cord 5 is wound around the second bobbin 7B. When the traverse pulley 81 traverses so as to wind the cord 5 by the first bobbin 7A, an engaging part 81a projecting downwardly from the traverse pulley 81 engages the contact maker 87a of the limit switch 87 and reverses the contact maker 87a as shown in FIG. 9. The operator can determine which bobbin is winding the cord by watching the contact maker 87a, or the limit switch 87 may be connected to a display means so as to display the particular bobbin winding the cord 5.

The first and the second bobbins 7A, 7B possess flange parts 7a, 7a, 7b, 7b fixed by screws 92, 92 to flange parts 91a, 91b formed on bobbin axes 91A, 91B respectively.

The bobbin axes 91A, 91B are supported rotatably by inserting their ends into casings 93A, 93B respectively. A driven synchronous pulley 94 is fixed to the inserted ends of bobbin axis 91A, 91B (the number of teeth on pulley 94 is 40 and only one synchronous pulley 94 in the casing 93A is shown in the drawing). This driven synchronous pulley 94 is connected to a drive synchronous pulley 96 through a synchronous belt 95. An end of a pulley shaft of the drive synchronous pulley 96 is inserted into another casing 97, which is interposed between the casings 93A and 93B. The pulley shift supported rotatably by a bearing 98a, and connected to a clutch shaft 100 through a first clutch means 99A. The clutch shaft 100 is supported rotatably in a central part of casing 97 by two bearings 101a, 101b. A synchronous pulley 102 (the number of teeth is 60) which connects to the driving means (not shown in the drawings) is fixed to the clutch shaft 100. Rotation driving means for rotating the axis of the winding bobbin at a constant speed is constructed in the above way. A first adjacent switch 103 for detecting one turn of the clutch shaft 100 is provided in vicinity of the clutch shaft 100.

On the opposite side of the clutch shaft 100, a pulley shaft 104 is connected to the clutch shaft 100 through a second clutch means 99B so that the driving force is transmitted to the second bobbin 7B in the same way.

In the vicinity of the screw rod 83, a second through a fifth adjacent switches 105A, 105B, 105C, 105D are respectively provided corresponding to the ends of bobbins 7A, 7B (near flange parts 7a, 7a, 7b, 7b) for detecting a position of a traverse pulley 81 so as to change the direction of the traverse pulley 81 (forwarding direction of the cord 5). In detail, a controller 110 receives signals from the second through the fifth adjacent switches 105A, 105B, 105C, 105D and controls the stepping motor 84 which controls the traverse movement of the traverse pulley 81. For example, the cord 5 is wound between the second adjacent switch 105A and the third adjacent switch 105B (between the flanges 7a) while winding the cord 5 around the first bobbin 7A. At the same time, the controller 110 receives joint part detecting signal F so that winding of the cord 5 is changed from one bobbin to the other bobbin.

Reference numeral 105 designates a cutter apparatus for cutting the cord 5 near the joint part 5c so that the cord 5 wound around the first bobbin 7A is separated from that wound around the second bobbin 7B.

Figure 10:
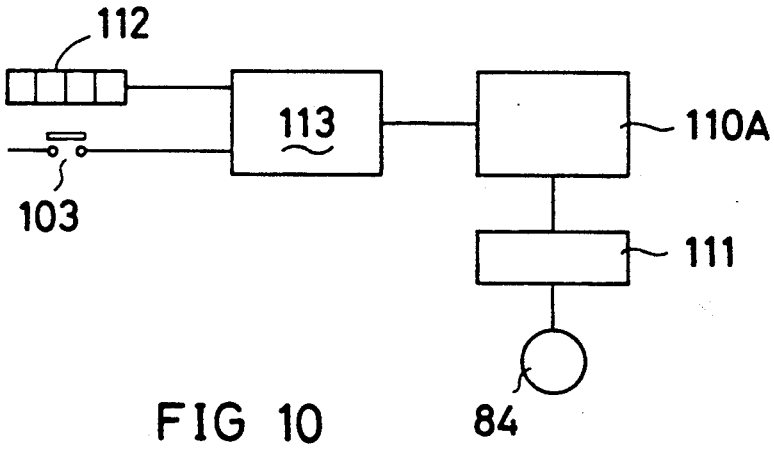
FIG. 10 is a block diagram of a control system for winding a cord continuously.

The stepping motor 84 is controlled by a controller 110A through a driver 111 as shown in FIG. 10. A control part 113 receives cord setting signals from a cord setting digital switch 112 and rotation signal from the first adjacent switch 103 so that the controls part 113 control the controller 110A.

Figure 11:
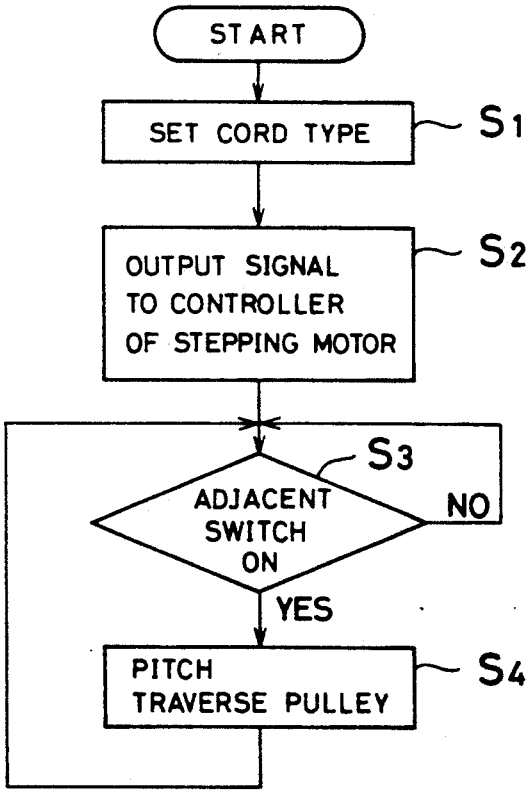
FIG. 11 is a flow chart, showing a flow of a continuous winding control.

The flow of the above apparatus is described in accordance with FIG. 11. First, when the control is started, the type of cord 5 is set by a cord setting digital switch 112 (Step S1). The control part 113 calculates a forward pitch on the basis of the above setting and controls the stepping motor 84 based on the pitch (Step S2).

Then, it is judged whether a rotation signal is sent from a first adjacent switch 103 (Step S3). When the rotation signal is sent, the clutch shaft 100 rotates by one turn. Therefore, the traverse pulley 81 is pitched corresponding to the rotation of the clutch shaft 100 (Step S4). When the rotation signal is not sent, the traverse pulley stays without being pitched.

Since the clutch shaft 100 and the bobbin axis 91A of the first bobbin 7A are connected to each other by synchronous belt 95 and synchronous pulleys 94, 96, the relationship between the bobbin axis 91A and the clutch shaft 100 is shown by the following equation:

$$25/45=0.625$$

Therefore, if the cord to be wound is 1.0 mm in diameter, when the clutch shaft rotates by one turn, the bobbin axis 91A rotates by 0.625 turn. Therefore, the cord 5 is pitched for 1*0.625=0.625 (mm) in an axial direction of the bobbin 7A by the traverse pulley 81.

Pitch of the cord is selected among pitches, which is already set and memorized for each type of the cord 5 in the controller A, by setting the type of the cord 5 by the cord setting digital switch 112 and inputting it into the control part 113. The cord 5 is forwarded by that pitch.

Thus, the pitch of the cord 5 is changed when the diameter of the cord 5 changes without requiring an electrically or mechanically complicated structure. Therefore, the cord 5 is wound in a neat roll around bobbins 7A, 7B.

Also, changing the pitch is easily done by the cord setting digital switch 112. In other words, the digital switch 112 determines the pitch of the cord 5 automatically by selecting the type of the cord 5 being used.

In the above embodiment, if the first adjacent switch 103 for detecting one turn of the clutch shaft 100 is provided at the bobbin axes 91A, 91B to detect the rotation of the bobbin axes 91A, 91B directly, the above ratio (0.625) is not required. However, in that case, one adjacent switch is required for each first and second bobbins 7A, 7B, which means two adjacent switches are needed. Therefore, the clutch shaft 100 is detected.

Figure 12:
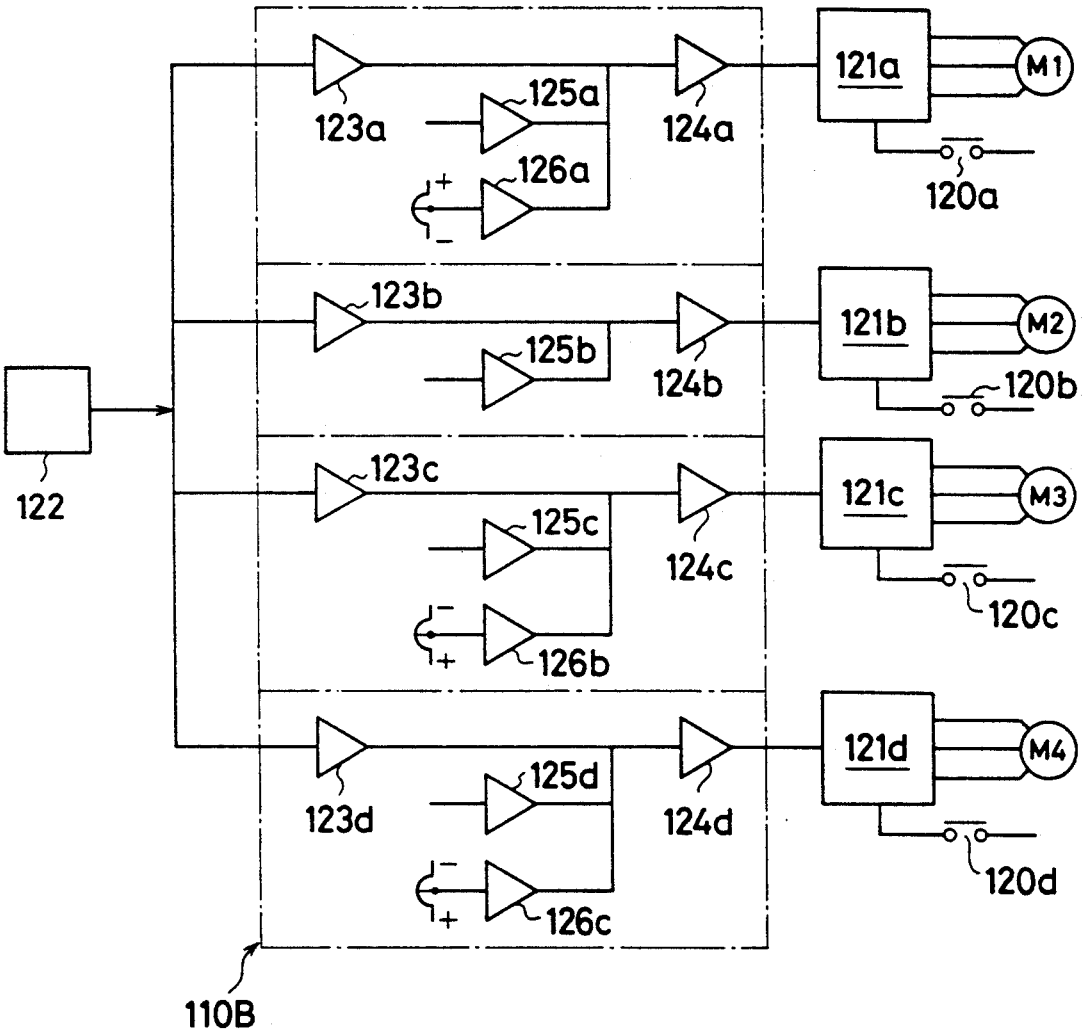
FIG. 12 show a circuit of a control system for a cord forward speed.

One example of a control part 110B which is a control system for controlling the driving of the driving motors M1, M2, M3, and M4 is shown in FIG. 12 with driving motor M1 located closest to the untreated cord supply side in a first motor position and driving motor M2 located in a second motor position downstream in the cord treating process from driving motor M1. Driving motors M1, M2, M3, and M4 are started by start switches 120*a*, 120*b*, 120*c*, and 120*d* and their rotation is controlled by inverter circuits 121*a*, 121*b*, 121*c*, and 121*d* respectively. Signals mainly set by a main setting circuit 122 are inputted to inverter circuits 121*a*–121*d* after being amplified by amplifiers 123*a*–123*d* respectively. At that moment, the signals are biased and corrected by bias setting circuits 125*a*–125*d*, and except for the signal the second driving motor M2, the signals are danced and corrected by correction circuits 126*a*–126*c*, which receive signals from detectors of the first through the third dancer apparatuses 65–67.

Figure 13:
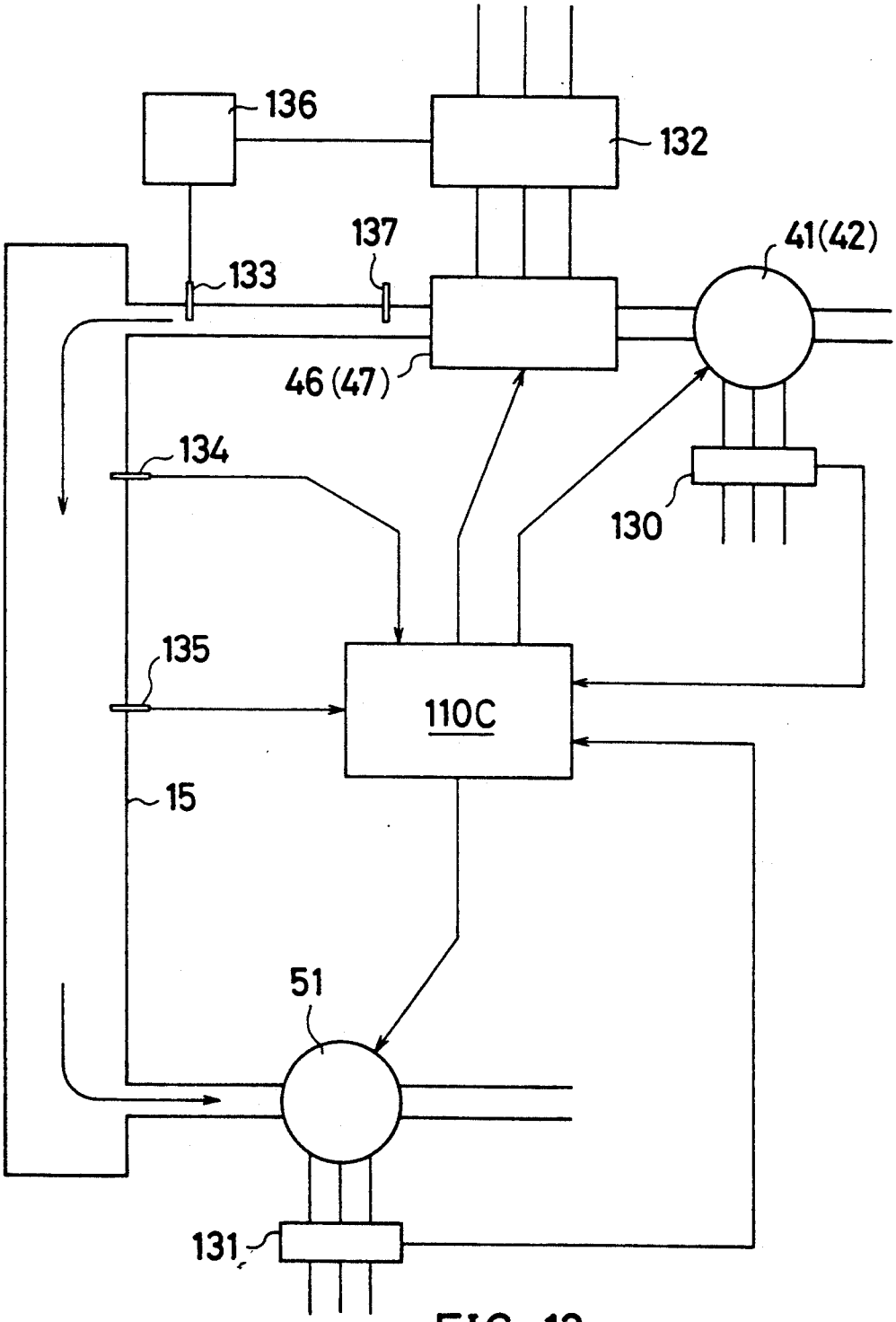
FIG. 13 is an explanatory drawing of a temperature regulating system of a first zone.

The temperature regulating system of the dip treating apparatus 1 includes, for example, for the first oven 15 as shown roughly in FIG. 13, blower a 41 (42) as an intake air fan and a blower 51 as an exhaust air fan connected to a power source (not shown in the drawing) through fan voltage detectors 130 and 131 respectively. Heaters 46, 47 are connected to a power source through a solid state contactor 132. A first thermocouple 133, a second thermocouple 134, and a third thermocouple 135 are provided on the oven 15 in the order given from the upstream side. The solid state contactor 132 is connected to the first thermocouple 133 through a temperature regulator 136. A thermostat 137 is provided between the heater 46 (47) and the first thermocouple 133. Thus, a controller 110*c* receives signals from fan voltage detectors 130, 131 and the second and third thermocouples 134, 135 so as to control the blowers 41 (42), 51 and heaters 46 (47).

The first zone Z1 which is noncirculating possesses a heating capacity of 10 kw*2 while it is second zone Z2 possesses a heating capacity of 10 kw and 15–85% of it is circulating. The third zone Z3 possesses a heating capacity of 10 kw and 15–85% of it is circulating, and a fourth zone Z4 possesses a heating capacity of 10 kw and it is noncirculating.

By the above structure, in the first zone Z1, for example, the untreated cord 5 drawn from the first cheese 4A is wound around between pull rollers of the first pull roller apparatus 61 by plural turns and tension in the cord is reduced. Then the cord is wound around the upper and lower dip rollers in the dip tank 1 by plural turns so as to process the first step of the dip treatment.

Thereafter, the cord is led into the first oven 15 for being dried and heated. In the over 15, the cord 5 is wound around between the upper and lower turn rollers 19, 23, by plural turns for drying of adhesives, drawing, and heat setting.

The cord 5 which is drawn out of the oven 15 passes the dancer apparatus 65 and is then wound around between the rollers 27, 31 by plural turns for being cooled. The cord 5, having a high temperature from being dried and heated in the oven 15 is cooled down below a specified temperature (temperature at which the physical properties of the cord are not changed).

The cord goes to the second zone Z2 through the second pull roller apparatus 62 interposed between the first zone Z1 and the second zone Z2.

Similar operations are carried out at the second through the fourth zones Z2–Z4 where different kinds of adhesives are used. Finally, the cord 5 is drawn out of the fourth oven 18 and wound around the winding bobbins 7A, 7B of the automatic winder 6.

In the untreated cord 5 supply side, when the cord 5 slips, a tension bar 65A of the first dancer apparatus 65 droops and the detector 65F detects it. The first driving motor M1 is decelerated in order to restrain the slips of the cord and not to accelerate the cord forward speed of the whole system. Thus, the speed of forwarding the cord 5 is restricted and stable dip treatment is carried out without affecting the second motor M2 and the third and the fourth motors M3, M4 and well.

Figure 14:
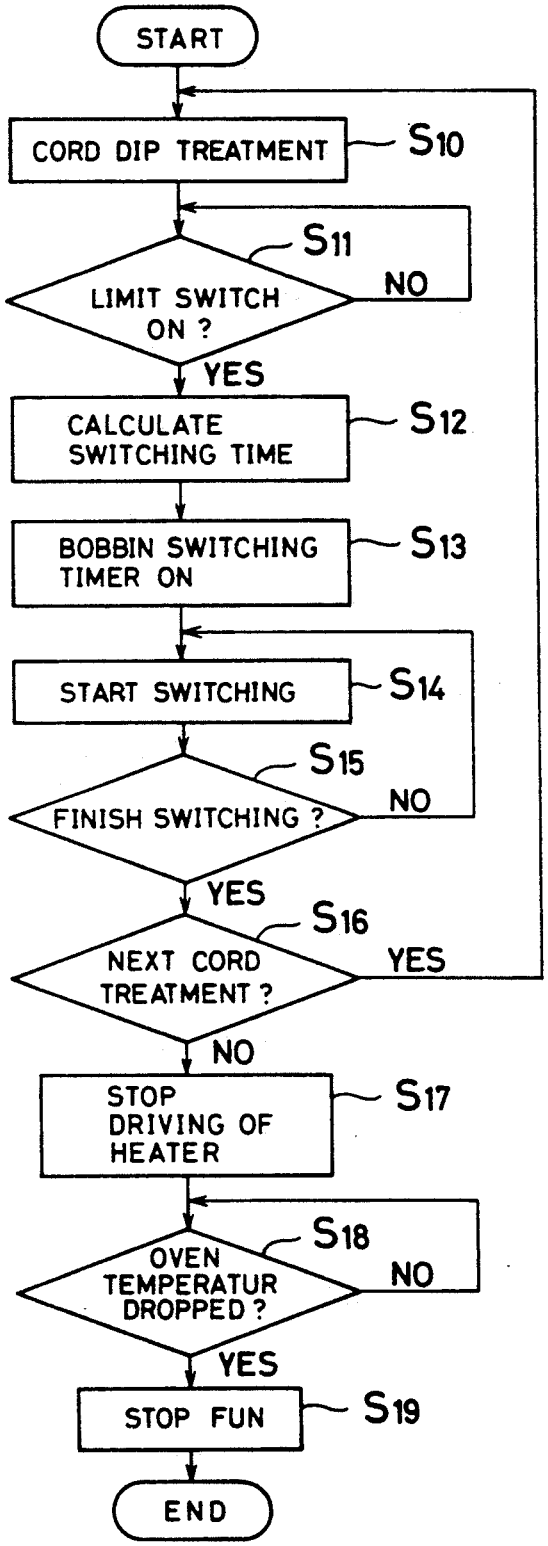
FIG. 14 is a flow chart for switching a bobbin.

Winding by the automatic winder 6 is controlled by the controller 110B in accordance with the flow chart of FIG. 14.

The cord of the first cheese 4A is dip treated (Step S10) right after the flow is started. Then, it is judged whether or not the limit switch 73 detects the joint part 5*c*, where the tail end of the cord 5 of the first cheese 4A joins with the front end of the cord 5 of the second cheese 5B (Step S11).

When the joint part detecting signal F is sent from the limit switch 73, bobbin switching time, i.e., time required to switch from the first bobbin 7A to the second bobbin 7B, is calculated from the following equation (Step S12):

Bobbin switching time = (distance between the limit switch 73 and the position of winding cord)/(processing time)

Thereafter, a bobbin switching timer (not shown in the drawing) is turned ON (Step S13), and the bobbin switching signal is outputted to the stepping motor 84. The winding bobbin is switched from 7A to 7B by the stepping motor 84 (Step S14).

In detail, the screw rod 83 is rotated by the stepping motor 84 and the movable stand 82 is controlled to move to a starting position where the second bobbin 7B starts winding the cord from a position corresponding to the first bobbin 7A after bobbin switching time has passed.

At that moment, since the limit switch 87 is interposed between the first bobbin 7A and the second bobbin 7B, the contact maker 87*a* of the limit switch 87 is reversed in the course of traversing the traverse pulley 81 (refer to FIGS. 8 and 9) to indicate to an operator that the second bobbin 7A has started winding the cord.

Then, it is judged whether the bobbin switching process is finished (Step S15) and whether the next cord is treated if the above bobbin switching process is finished (Step S16). The driving of the heater is stopped if the cord is not treated (Step S17), and dip treatment of the cord continues if the cord is treated. If switching the bobbin is not finished at step S15, that process should be continued.

The flow continues as follows: it is judged whether or not the temperature inside of the oven is lowered below a specified temperature (Step S18). This inquiry is repeated if the temperature is not lowered, and if the temperature is lowered, an exhaust fan is stopped (Step S19) stopping the flow.

The dip treatment is processed as mentioned above. When the dip treatment is finished, the front end of the aromatic polyamide cord (wound around the cheese), which is a cord for heating and, therefore, deformed by heat when used at an elevated temperature at the start of the next dip treatment, joins to the tail end of the cord 5 treated last. When the dip treatment is finished and the limit switch 73 for detecting the joint part is turned ON by detecting the joint part where the cord 5 treated last joints with the aromatic polyamide cord, operation of the heater and cord forwarding is stopped when the joint part reaches the automatic winder 6. Then, when the temperature inside of ovens 15–18 is lowered below the specified temperature, blowers 41–44 as intake air fans and blowers 51–53 as exhaust air fans are stopped.

In this manner, the aromatic polyamide cord for heating, which is positioned not deformed by heat, is inside the ovens 15–18 at the start of the next dip treatment and heating process. The aromatic polyamide core is at the elevated temperature for starting the next dip treatment. Therefore, the cord is not deformed by heat.

Figure 15:
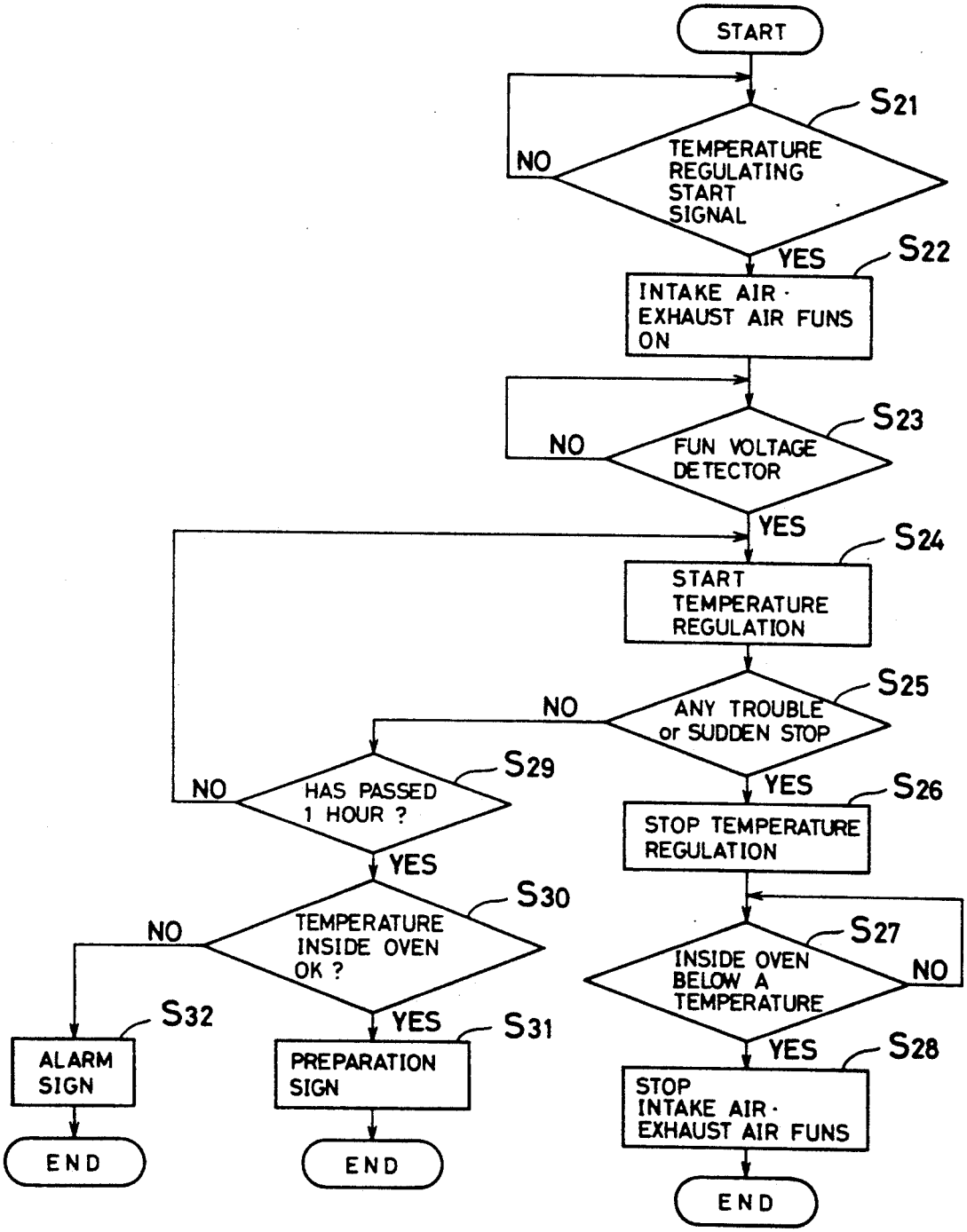
FIG. 15 is a flow chart for temperature adjusting.

A process of raising the temperature of the cord dip treating apparatus processed by controller 110*c* is described below in accordance with FIG. 15. Although four ovens are provided, heating the processes are all similar.

Right after start, it is judged whether or not the temperature regulating signal is received (Step S21). If the temperature regulating signal is received, blowers 41–44 as intake air fans and blowers 51–53 as exhaust air fans are turned ON (Step S22). If the temperature regulating signal is not received, the inquiry at step S21 is repeated.

After step S22, it is judged whether or not the fans voltage detectors 110, 111 are ON (Step S23) temperature and regulating process is started if the voltage detectors 110, 111 are ON (Step S24). If the voltage detectors 110, 111 are not ON, the inquiry at step S23 is repeated until the voltage detectors 110, 111 are turned ON since the blowers 41–44, 51–53 are not operated.

After temperature regulation is started, it is judged whether or not there is any trouble or sudden stop (Step S25). If that judgment is YES, temperature regulation is stopped (Step S26). Then, it is judged whether or not the ovens 15–18 are below a specified temperature by signals from thermocouples 113, 114, 115 (Step S27). If they are below the specified temperature, blowers 41–44 as intake air fans and blowers 51–55 as exhaust air fans are stopped (Step S28). The flow is finished here. However, if they are not below the specified temperature, the inquiry at step S27 is repeated.

If the judgment at step S25 is NO, it is judged whether or not one hour has passed (Step S29). If one hour has passed, it is judged whether the temperature inside of the ovens 15–18 is OK, i.e., the temperature is over a specified temperature (Step S30). If it is OK, lamp, buzzer, and so on indicate that the apparatus is prepared (Step S31). If it is not OK, lamp, buzzer, and so on alarm (Step S32). Then the flow is finished. If one hour has not passed at step S29, the flow is returned to step S24.

Before this temperature regulating process, front the end of a cord for subsequent dip treatment, for example, a polyester cord, joins to the tall end of the aromatic polyamide cord which for the temperature regulating process. Therefore, if the cord has begun forwarding after regulating the temperature process, the joint part turns the limit switch 73 for detecting the joint part ON so that the dip treated cord is wound around the other bobbin after the aromatic polyamide cord is wound around one bobbin. The aromatic polyamide core wound around the one bobbin is then removed and reused.

What is claimed is:

1. An apparatus for dip treating and winding a cord having a plurality of driving motors which control a forward speed of said cord, said apparatus for dip treating and winding said cord comprising:

an untreated cord supply;

a plurality of controlled driving motors for pulling said cord through the dip treating and winding apparatus, said plurality of controlled driving motors including a first driving motor for pulling said cord from said untreated cord supply;

a second driving motor positioned downstream of said first driving motor in a second motor position from said untreated cord supply for pulling said cord from said first driving motor; and control means for maintaining a substantially constant rotating speed of said second driving motor and for variably controlling a speed of rotation of said plurality of controlled driving motors relative to the forward speed of said cord by receiving signals from a dancer apparatus for detecting changes of the forward speed of said cord.

* * * * *